US007671808B2

(12) United States Patent
Boyle

(10) Patent No.: US 7,671,808 B2
(45) Date of Patent: Mar. 2, 2010

(54) COMMUNICATION DEVICE AND AN ANTENNA THEREFOR

(75) Inventor: Kevin R. Boyle, Horsham (GB)

(73) Assignee: NXP B.V., Eindhoven (NL)

( * ) Notice: Subject to any disclaimer, the term of this patent is extended or adjusted under 35 U.S.C. 154(b) by 197 days.

(21) Appl. No.: 10/563,649

(22) PCT Filed: Jul. 2, 2004

(86) PCT No.: PCT/IB2004/002235

§ 371 (c)(1),
(2), (4) Date: Jan. 6, 2006

(87) PCT Pub. No.: WO2005/006493

PCT Pub. Date: Jan. 20, 2005

(65) Prior Publication Data

US 2006/0234657 A1 Oct. 19, 2006

(30) Foreign Application Priority Data

Jul. 10, 2003 (GB) ..... 0316169.2

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 6,414,641 | B1 * | 7/2002 | Carlson et al. | 343/702 |
| 6,662,028 | B1 * | 12/2003 | Hayes et al. | 455/575.7 |
| 6,911,942 | B2 * | 6/2005 | Fukuda et al. | 343/700 MS |
| 2002/0140612 | A1 * | 10/2002 | Kadambi et al. | 343/702 |
| 2003/0098813 | A1 * | 5/2003 | Koskiniemi et al. | 343/702 |
| 2003/0103010 | A1 | 6/2003 | Boyle | |
| 2003/0132885 | A1 * | 7/2003 | Kuramoto et al. | 343/702 |
| 2004/0095281 | A1 * | 5/2004 | Poilasne et al. | 343/702 |
| 2004/0252062 | A1 * | 12/2004 | Tracy et al. | 343/702 |

FOREIGN PATENT DOCUMENTS

| | | | |
|---|---|---|---|
| EP | 0932219 | A2 | 7/1999 |
| WO | WO0124311 | A1 | 4/2001 |
| WO | WO0137369 | A1 | 5/2001 |

* cited by examiner

*Primary Examiner*—Douglas W Owens
*Assistant Examiner*—Dieu Hien T Duong

(57) ABSTRACT

A communications device, such as a cellular telephone, comprises a RF circuit and a PIFA antenna having feed and shorting terminations. An electrically conductive, self supporting member is provided to effect a connection between contact points of the RF circuit and the antenna. The member has at least one feed pillar and a shorting pillar which are substantially permanently connected to respective contact points of the RF circuit, and an antenna interface which forms a pressure connection with the terminations of the antenna.

19 Claims, 2 Drawing Sheets

COMMUNICATION DEVICE AND AN ANTENNA THEREFOR

Figure 1:
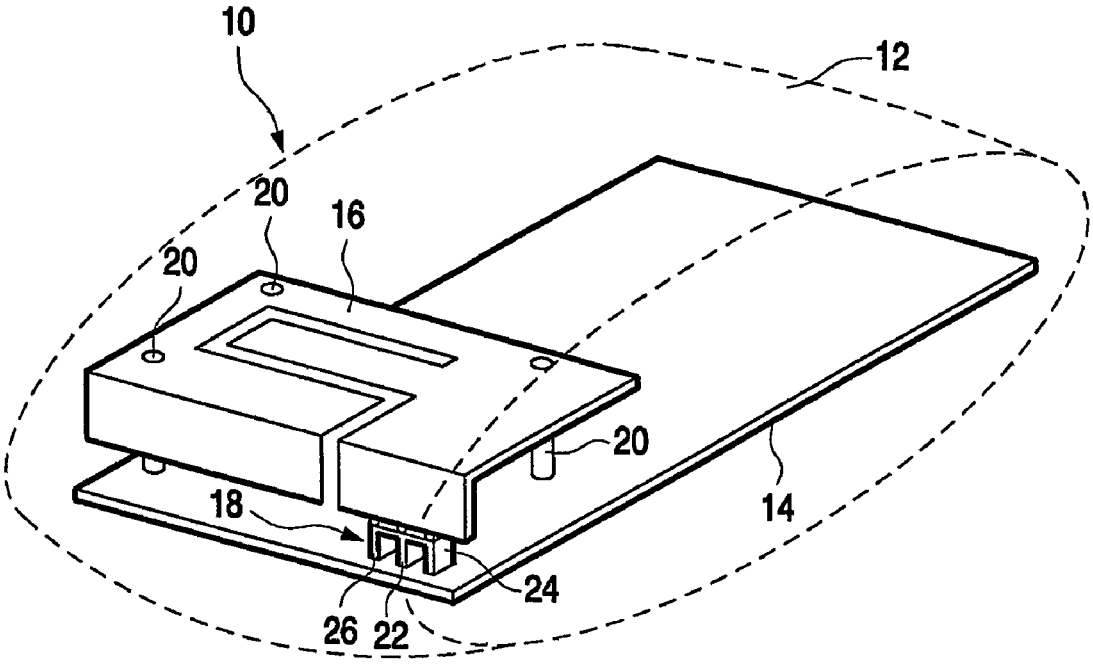

The present invention relates to a communications device, such as a cellular telephone, and to an antenna for use in the communication device.

PIFAs (Planar Inverted-F Antennas) have become popular with manufacturers of cellular telephones because they exhibit a low SAR performance and they are installed above the phone circuitry within the space formed by the housing parts. Consequently they do protrude from the housing as was the case when helical antennas were used. Normally the electrical connections from the PIFA to the printed circuit board (PCB) containing the phone circuitry comprise a shorting tab and one or more feed tabs. A pressure connection is normally made either at the PCB or the interface with the antenna top plate.

Patent Specification WO 01/37369 discloses an antenna made from sheet metal or flex film having two folded, perpendicular legs constituting a grounding (or shorting) element and a feeding element. The other ends of the legs are free and are folded-back to provide U-shaped contact areas. In use the U-shaped contact areas are juxtaposed with contact points provided on the high contact pressure. This Specification also discloses the provision of an impedance matching element extending between the legs.

It has been shown, Kevin Boyle, "Radiating and Balanced Mode Analysis of PIFA Shorting Pins", IEEE AP-S International Symposium and USNC/URSI National Radio Science Meeting, San Antonio, Tex., 16-21 June, Vol.4, pp. 508-511, that there are significant common and differential mode currents in the feed and shorting pins of conventional PIFAs. This puts demands on the quality of the pressure connections of the feed and shorting pins, and also leads to loss in any nearby supporting structures Further, it has been shown by K. R. Boyle, "Differentially Slotted and Differentially Filled PIFAs", Electronics Letters Vol. 39, No. 1, pp. 9-10, January 2003 that the gap between the feed and shorting pins can be filled to form part of a bandwidth broadening resonant circuit. This tends to increase the circulating currents in the feed and shorting pins. The remainder of the resonant circuit, that is, a discrete capacitor, is placed on the PCB (or module). Hence the interface between the feed and shorting pins and the PCB becomes even more critical.

An object of the present invention is to make the interface between the feed and shorting pins and the PCB less critical.

According to a first aspect of the present invention there is provided a communications device comprising a rf circuit and an antenna, wherein the rf circuit includes coupling means for connecting the rf circuit to the antenna, the coupling means comprising an electrically conductive, self supporting member having at least one feed pillar and a shorting pillar, the pillars being substantially permanently connected to respective contact points of the rf circuit, and an antenna interface forming a pressure connection with the antenna.

According to a second aspect of the present invention there is provided a rf module comprising a supporting member having rf circuit components thereon and coupling means for connecting an rf output to an antenna, the coupling means comprising an electrically conductive, self supporting member having at least one feed pillar and a shorting pillar, the pillars being substantially permanently connected to respective contact points of the rf circuit, and an antenna interface for coupling to the antenna.

According to a third aspect of the present invention there is provided an antenna comprising a signal propagating and/or receiving element having at least one rf feed termination and a shorting termination, and an electrically conductive, self supporting element having at least one feed pillar and a shorting pillar to be substantially permanently connected to respective contact points of an rf circuit, and an antenna interface providing a pressure connection with the at least one rf feed termination and the shorting termination.

The self supporting member functions to move the antenna interface such that all of the critical areas are part of the PCB or module. The self supporting member including the feed and shorting pillars is a relatively small component that is part of the rf circuit and is therefore well controlled. An advantage of the member being a self supporting component is that it does not suffer from losses associated with supporting structures. The substantially permanent connection of the pillars to the respective contact points of the rf circuit may be effected by directly soldering. This has the advantage that the soldering can be well controlled and be repeatable thus avoiding problems due to poor connections in combination with high currents. The antenna interfaces to this self supporting component at a point where differential mode currents are no longer present.

Figure 2:
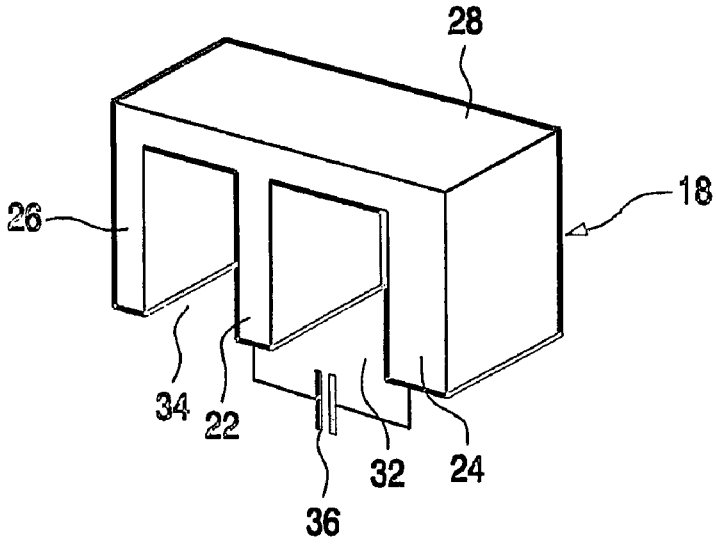
Figure 3:
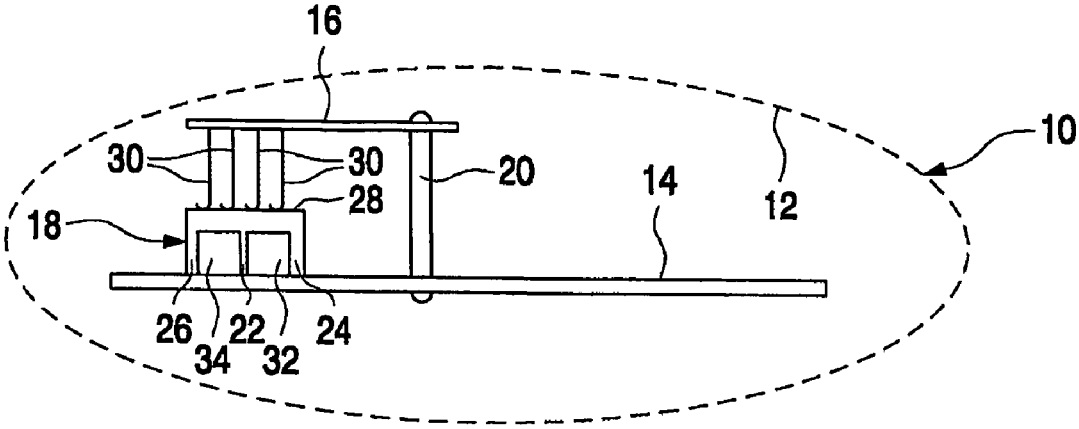

The present invention will now be described, by way of example, with reference to the accompanying drawings, wherein:

FIG. 1 is a sketch of a cellular telephone having a dual band antenna connected by the self supporting component to rf circuitry on a PCB, FIG. 2 is a perspective view of the self supporting component for use with a dual band antenna, and FIG. 3 is a diagram showing one embodiment of effecting an electrical connection between the antenna and the self supporting component.

In the drawing the same reference numerals have been used to indicate corresponding features.

Referring to FIG. 1, a dual standard, say GSM and DCS, cellular telephone 10 comprises a housing 12 which contains a printed circuit board 14 carrying rf, AF and other components, including a programmed microcontroller, required for the operation of the telephone 10. In the interests of brevity and clarity the mentioned other components are not shown as they are not required for an understanding of the present invention.

A dual band PIFA 16 is carried on the PCB 14 using a self supporting, electrically conductive feed component 18 and three mounting posts 20. In another non-illustrated embodiment the PIFA is supported by the back cover of the telephone 10 and abuts the feed component 18.

Referring to FIG. 2, the component 18 may be entirely metallic, for example copper, or a metalized insulating material, for example plastics or ceramic. In the illustrated dual feed example, the component 18 comprises a middle, shorting or ground pillar 22 and outer feed pillars 24, 26 for GSM and DCS signals, respectively. In the event of the cellular telephone being a single standard telephone only one feed pillar is required.

The free ends of the pillars 22, 24, 26 are secured, for example soldered, to respective contact pads (not shown) on the part of the PCB 14 having rf components. Soldering allows standard, accurate pick and place techniques to be used. In turn this allows much more accurate and repeatable fabrication of the resonant structure.

The upper surface of the component 18 comprises an antenna interface 28. Contact with the antenna 16 is by a pressure connection. FIG. 3 shows an example of the antenna having a plurality of spring contacts 30 resiliently pressing against the antenna interface 28. The large available area of the interface 28 and the lack of differential mode currents at this point improve the quality of this interface. Also interfacing at this point improves the repeatability of the antenna impedance which improves the consistency in the rf performance parameters.

In a variation of the illustrated embodiment the gap(s) 32, 34 between the feed pillars 24, 26 and the shorting pillar 22 may be filled to form part of a bandwidth broadening resonant circuit. The remainder of the resonant circuit, for example a discrete capacitor, is placed on the PCB 14. Hence the interface between the feed and shorting pillars and the PCB becomes even more critical. If required one or more resonating capacitors, for example a capacitor 36 (FIG. 2), may be embedded in the metalized insulating material, for example ceramic, of the component 18.

In the present specification and claims the word "a" or "an" preceding an element does not exclude the presence of a plurality of such elements. Further, the word "comprising" does not exclude the presence of other elements or steps than those listed.

From reading the present disclosure, other modifications will be apparent to persons skilled in the art. Such modifications may involve other features which are already known in the design, manufacture and use of communication devices and component parts therefore and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalization thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

The invention claimed is:

1. A communications device comprising a RF circuit and an antenna connected by a self supporting member providing support for the antenna, the self supporting member having at least one feed pillar and a shorting pillar, the pillars being substantially permanently connected to respective contact points of the RF circuit and extending from the RF circuit to an antenna interface of the self supporting member, the antenna connected to the antenna interface by a pressure connection; wherein the antenna comprises a dual band, dual feed antenna, characterised in that the self supporting member has two feed pillars disposed one on either side of the shorting pillar.

2. A device as claimed in claim 1, characterised in that the self supporting member is metallic.

3. A device as claimed in claim 1, characterised in that the self supporting member comprises a metallised insulating material.

4. A device as claimed in claim 1, characterised in that the self supporting member comprises a metallised insulating material having at least one embedded capacitor.

5. A device as claimed in claim 1 characterised in that the antenna is a PIFA.

6. A device as claimed in claim 1, wherein the antenna interface is located to minimize differential mode currents.

7. A device as claimed in claim 1, wherein an area between the at least one feed pillar and the shorting pillar is adapted to accommodate at least part of a bandwidth broadening resonant circuit.

8. A RF module comprising a supporting member having RF circuit components thereon and a connector to connect an RF output to an antenna, the connector comprising an electrically conductive, self supporting member having at least one feed pillar and a shorting pillar providing support, the pillars being substantially permanently connected to respective contact points of the RF circuit components and extending from the contact points to an antenna interface of the self supporting member, the antenna interface adapted for coupling to the antenna by a pressure connection; wherein the antenna comprises a dual band, dual feed antenna, characterised in that the self supporting member has two feed pillars disposed one on either side of the shorting pillar.

9. A module as claimed in claim 8, characterised in that the self supporting member is metallic.

10. A module as claimed in claim 8, characterised in that the self supporting member comprises a metallised insulating material.

11. A module as claimed in claim 8, characterised in that the self supporting member comprises a metallised insulating material having at least one embedded capacitor.

12. An antenna comprising a signal propagating and/or receiving element having at least one RF feed termination and a shorting termination, and an electrically conductive, self supporting member having an antenna interface, at least one feed pillar, and a shorting pillar extending from the antenna interface, the pillars adapted to be substantially permanently connected to respective contact points of an RF circuit, and the antenna interface providing a pressure connection with the at least one RF feed termination and the shorting termination;

wherein the antenna comprises a dual band, dual feed antenna, characterised in that the self supporting member has two feed pillars disposed one on either side of the shorting pillar.

13. A device as claimed in claim 1, wherein the antenna is further supported by mounting posts disposed between the antenna and the RF circuit around the antenna periphery.

14. A device as claimed in claim 1, further comprising a housing and wherein the antenna is supported by the housing.

15. A device as claimed in claim 1, wherein the antenna includes a plurality of spring contacts to form the pressure connection with the antenna interface.

16. A device as claimed in claim 15, wherein the antenna interface is located to minimize differential mode currents.

17. A device as claimed in claim 16, wherein an area between the at least one feed pillar and the shorting pillar contains part of a bandwidth broadening resonant circuit, a remaining portion of the bandwidth broadening resonant circuit residing on a circuit board that contains the RF circuit.

18. An antenna as claimed in claim 12, wherein the antenna includes at least one spring contact to form the pressure connection with the antenna interface.

19. An antenna as claimed in claim 18, wherein the pressure connection is located to minimize differential mode currents.

* * * * *